US011484929B2

(12) United States Patent
Caporusso

(10) Patent No.: US 11,484,929 B2
(45) Date of Patent: Nov. 1, 2022

(54) HYDRAULICALLY OPERATED ROTARY PIPE BENDING MACHINE

(71) Applicant: CML INTERNATIONAL S.P.A., Piedimonte San Germano (IT)

(72) Inventor: Alessandro Caporusso, Piedimonte San Germano (IT)

(73) Assignee: CML INTERNATIONAL S.P.A., Piedimonte San Germano (IT)

( * ) Notice: Subject to any disclaimer, the term of this patent is extended or adjusted under 35 U.S.C. 154(b) by 0 days.

(21) Appl. No.: 16/771,848

(22) PCT Filed: Dec. 10, 2018

(86) PCT No.: PCT/IB2018/059812

§ 371 (c)(1),
(2) Date: Jun. 11, 2020

(87) PCT Pub. No.: WO2019/116191

PCT Pub. Date: Jun. 20, 2019

(65) Prior Publication Data

US 2021/0170467 A1 Jun. 10, 2021

(30) Foreign Application Priority Data

Dec. 11, 2017 (IT) ..... 102017000142179

(51) Int. Cl.
*B21D 7/024* (2006.01)

(52) U.S. Cl.
CPC ..... *B21D 7/024* (2013.01)

(58) Field of Classification Search
CPC ..... B21D 7/024; B21D 9/07
See application file for complete search history.

(56) References Cited

U.S. PATENT DOCUMENTS 2,096,574 A * 10/1937 Denny ..... B21D 7/06 60/478
2,661,788 A * 12/1953 Esslinger ..... B21D 7/021 72/406

(Continued)

FOREIGN PATENT DOCUMENTS

DE 3019111 A1 11/1981
EP 0611611 A1 * 8/1994 ..... B21D 7/063

(Continued)

OTHER PUBLICATIONS

International Search Report, dated Mar. 15, 2019, from corresponding PCT application No. PCT/IB2018/059812.

*Primary Examiner* — Adam J Eiseman
*Assistant Examiner* — P Derek Pressley
(74) *Attorney, Agent, or Firm* — Nixon & Vanderhye

(57) ABSTRACT

A hydraulically operated rotary pipe bending machine has a box (1) from which superiorly protrude a die shaft (2) that is rigidly connected to a die and integral with a die gear (29) being driven by an actuator (30) through a hydraulic circuit and being stopped by a limit switch device (8), and a counter-die unit (3) driven by a handwheel (4) in order to place an elongated piece to be bent against said die. The actuator (30) has a single-acting cylinder, having a piston (31) holding a rack rod (30*a*) engaging said die gear (29), the piston (31) being opposed in its travel by a return spring (33). The limit switch device (8) has an angularly graduated disc (10) mounted, manually adjustable, on the die shaft (2) and provided with a cam (16) designed to control said limit switch (17) of the hydraulic circuit.

6 Claims, 4 Drawing Sheets

(56) References Cited

U.S. PATENT DOCUMENTS

| | | | | | |
|---|---|---|---|---|---|
| 2,709,473 | A | | 5/1955 | Grace et al. | |
| 3,276,235 | A | * | 10/1966 | Stanley | B21D 7/02 72/149 |
| 3,696,481 | A | * | 10/1972 | Schmidt | B21D 9/073 29/33 T |
| 4,141,235 | A | * | 2/1979 | Ishihara | B21D 7/066 72/213 |

FOREIGN PATENT DOCUMENTS

| | | | | |
|---|---|---|---|---|
| FR | 1148867 | A | | 12/1957 |
| KR | 101642675 | B1 | * | 7/2016 |
| KR | 101642675 | B1 | | 7/2016 |

* cited by examiner

HYDRAULICALLY OPERATED ROTARY PIPE BENDING MACHINE

TECHNICAL FIELD

The present invention relates to a hydraulically operated rotary pipe bending machine.

BACKGROUND ART

KR-101642675 B1 discloses a hydraulically operated rotary pipe bending machine, comprising a machine body with a die shaft integral with a die gear driven by an actuator through a hydraulic circuit and stopped by a limit switch device, and a counter-die driven by a handwheel to bring an elongated piece to bend against said die. The actuator is a double-acting hydraulic cylinder, working in both a bending operation and a return or discharge operation always by the hydraulic circuit. For this purpose, the hydraulic cylinder controls a rack element. It should be evident that the power to bend the elongated piece is only necessary in the bending operation and not in the discharge operation. Therefore, using the double-acting hydraulic circuit also in the discharge operation makes the pipe-bending machine more complicated. The use of the double-acting hydraulic cylinder increases the costs of the machine. Further, the above-mentioned pipe bending machine provides a limit switch device controlled by a handwheel to fix the bending angle, with a consequence that the limit switch device is complex and then increases the machine costs. Furthermore, the rack element, being engaged with the die gear, is completely inside the above-mentioned pipe-bending machine. This involves an increase in the size of the body of the machine, and therefore in its cost.

SUMMARY OF THE INVENTION

The objects of the present invention are to overcome the drawbacks mentioned above.

The main object of the invention is to provide a high-power bending machine that is of a light weight, possibly portable and not cumbersome, and may not require the use of electrical energy.

Another object of the invention is to provide a machine in which it is simple to set the desired angle of rotation for the pipe to be bent.

In order to achieve the aforementioned purposes, the present invention, as defined in claim 1 attached to the present description, provides a hydraulically operated rotary pipe bending machine, comprising a box from which superiorly protrude both a die shaft, rigidly connected to a die and integral with a die gear driven by an actuator through a hydraulic circuit and stopped by a limit switch device, and a counter-die unit driven by a handwheel for approaching an elongated piece to be bent against said die, wherein said actuator comprises a single effect cylinder, having a piston carrying a rack-like rod engaged with said die gear, the piston being opposed in its travel by a return spring.

Another relevant feature of the invention is that the box of the pipe-bending machine has a front opening for the protrusion of the actuator rack-like rod. Advantages mainly consist in that the machine according to the invention is more compact, since the toothing of the rack-like rod can protrude from the box of the machine through the front opening. In addition, the pipe-bending machine is lighter because it has fewer components, and then is even cheaper.

Suitably, the return spring performs a function of automatically bringing both the piston and the die back to the initial zero point thanks to the mechanical pinion-rack-piston connection, preparing the machine for the subsequent bending.

Advantageously, the limit switch device comprises, as will be seen below, a clutched disc, a cam and a limit switch. The clutched disc allows to set the desired bending angle. The adjustment range is 0-210 degrees with a single stroke of the single effect cylinder.

BRIEF DESCRIPTION OF DRAWINGS

Further features and advantages of the present invention will become most apparent from the description of an embodiment of the hydraulically operated rotary pipe bending machine, illustrated by way of an indicative and therefore non-limiting example in the accompanying drawings, in which.

DESCRIPTION OF INVENTION EMBODIMENTS

Figure 1:
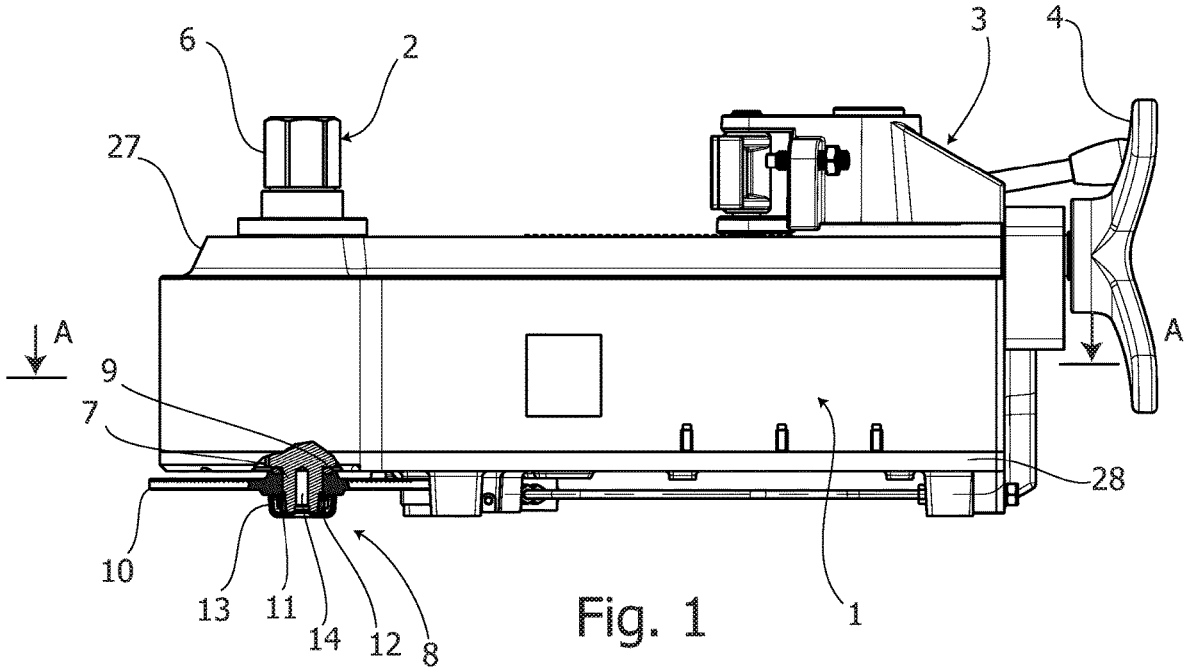
FIG. 1 is a partially cross-sectioned side view of the rotary pipe bending machine according to the invention.

Initially, reference is made to FIG. 1 which is a partially cross-sectioned side view of the hydraulically operated rotary pipe bending machine according to the invention. The rotary pipe bending machine has a box 1 from which a die shaft 2 protrudes superiorly, rigidly connected to a die not shown, and a counter-die unit 3 driven by a handwheel 4. The counter-die unit 3 conventionally carries a support 5 for a counter-die not shown. The counter-die unit 3 serves to bring an elongated piece to be bent (not shown) against said die. The counter-die unit 3 is of a traditional type; therefore, even if it is fully illustrated, it will not be described in detail below.

The die shaft 2 has a polygonal profile end 6 for the connection with the die. On the opposite side to the polygonal profile end 6, according to the invention, a lower end 7 of the die shaft 2 carries a limit switch device indicated generally at 8. The limit switch device 8 comprises a friction ring 9 on which an angularly graduated disc 10, numbered at 90 degrees intervals, rests. The angularly graduated disc 10 is mounted concentrically to the friction ring 9 and held thereon by cup springs 11 retained by a ring nut 12. A cover 13 closes the lower end 7 of the die shaft 2 by means of a screw 14. As an alternative to the friction ring 9 and the cup springs 11 retained by the ring nut 12, a clamping lever mounted at the lower end 7 of the die shaft 2 can be provided.

Figure 2:
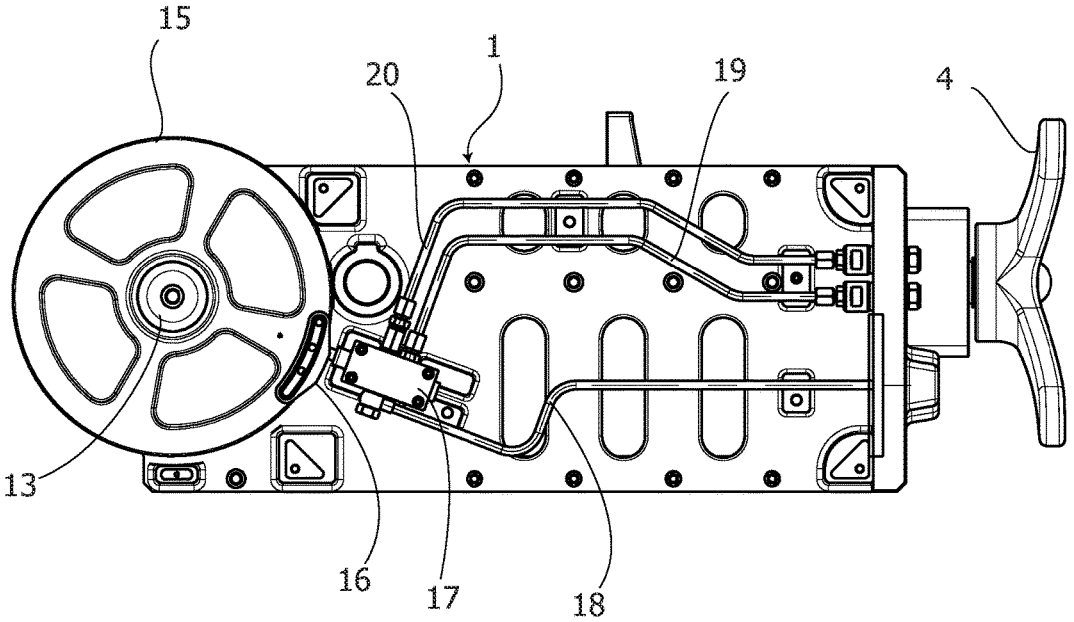
FIG. 2 is a plan view from the bottom of the rotary pipe bending machine in FIG. 1.

As shown in FIG. 2, which is a plan view from the bottom of the hydraulically operated rotary pipe bending machine according to the invention, the angularly graduated disc 10 is supported by a spoked wheel 15 having a cam 16 in its periphery. Advantageously, the angularly graduated disc 10 is made in one piece with the spoked wheel 15. The cam 16 cooperates with a limit switch 17 being part of a hydraulic circuit shown below. In this hydraulic circuit, an oil supply pipe to the actuator is indicated as 18, an oil discharge pipe downstream of the limit switch 17 is indicated as 19, and indicated as 20 is an oil delivery line by means of a pump, as will be seen below.

Figure 3:
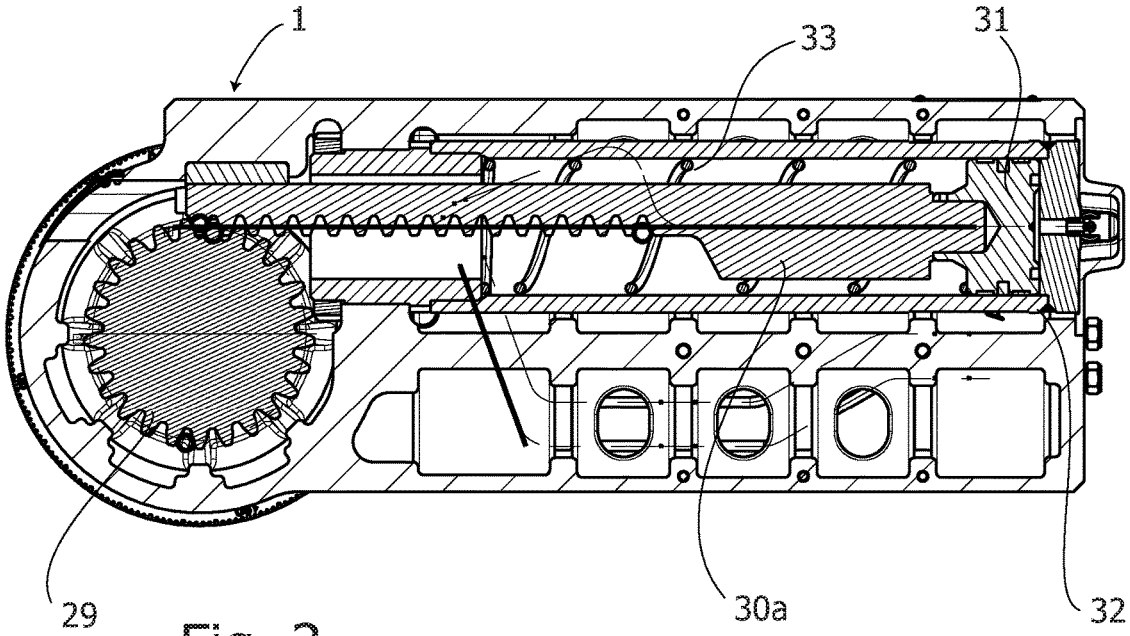
FIG. 3 is a cross-section view taken along line A-A in FIG. 1.

FIG. 3 shows a cross-section view taken along the line A-A in FIG. 1. As shown, a die gear 29 integral with the die shaft 2 is engaged with a rack rod 30*a* mounted on a piston 31 opposed by a return spring 33 in a single acting cylinder 32. The rack rod 30*a* has a rack 30*b* in one piece. This arrangement makes the machine more compact and, therefore, less cumbersome.

Figure 4:
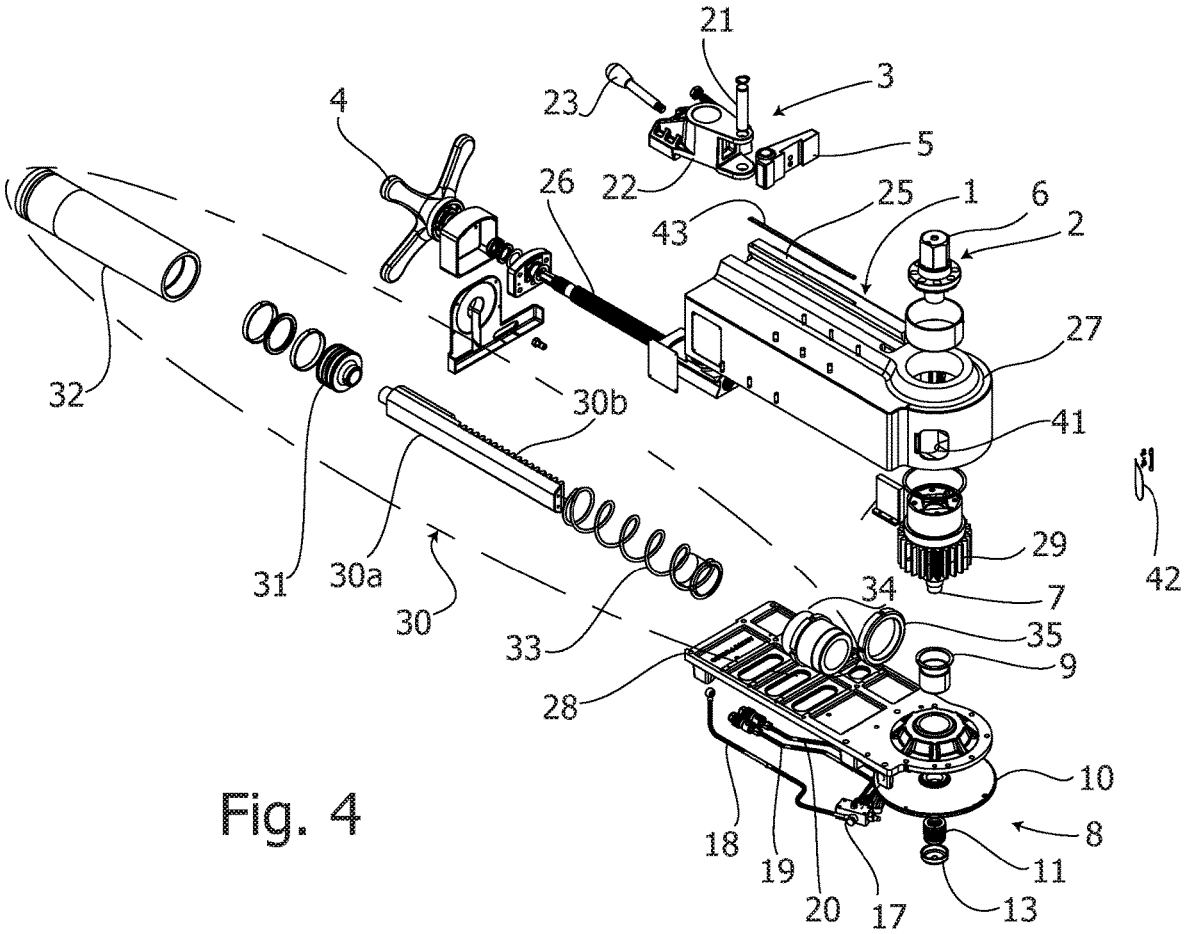
FIGS. 4 and 5 are exploded perspective views of the rotary pipe bending machine in FIG. 1 from the left and from the right, respectively.
Figure 5:
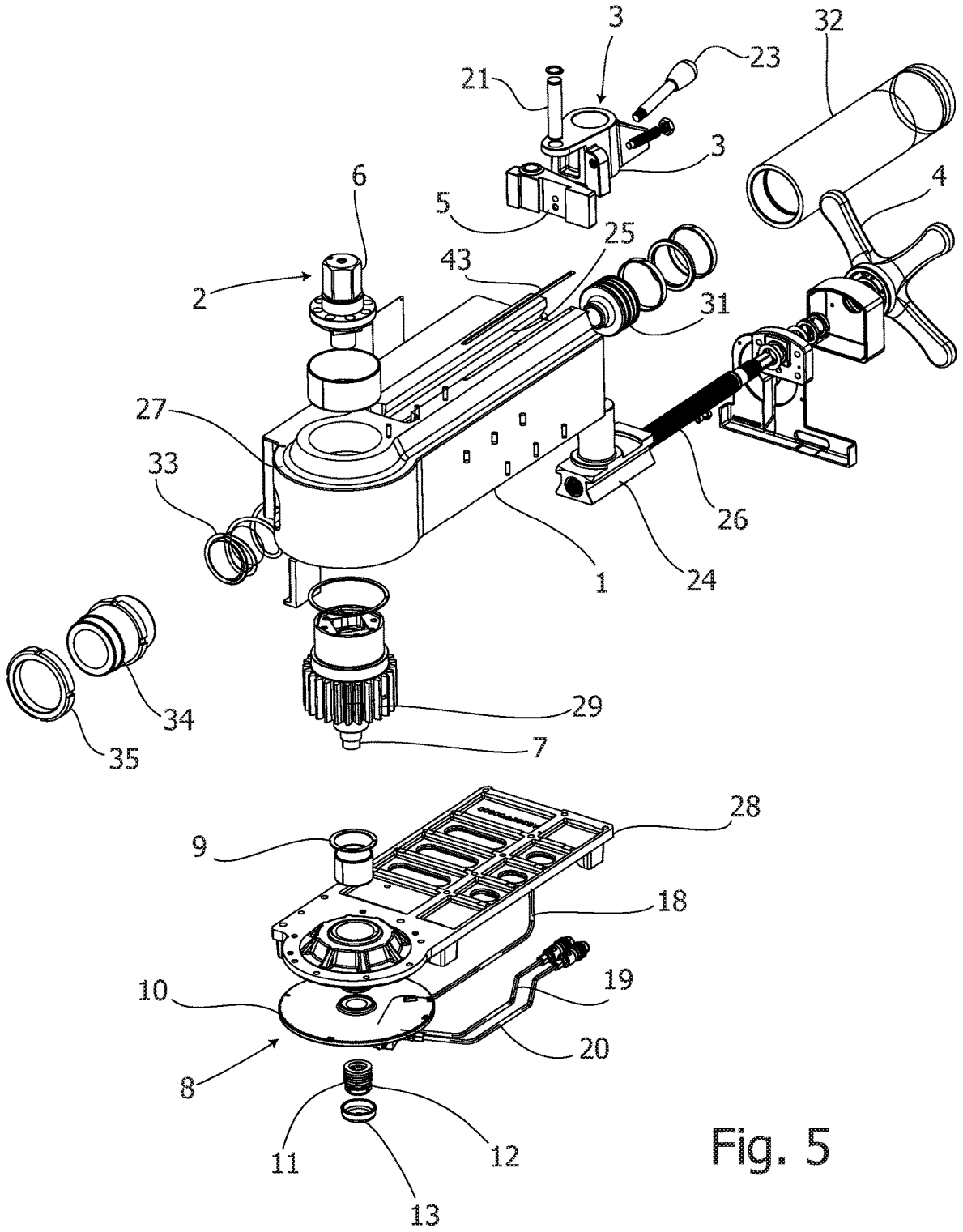

This is shown mostly in detail in FIGS. 4 and 5 which are exploded perspective views of the rotary pipe bending machine in FIG. 1, from the left and the right respectively. It can be noted that the support 5 for the counter-die 3 is mounted with a pin 21 on a bracket 22 provided with a lever arm 23 and mounted on a slider 24 sliding in a dovetail grooved profile 25. The slider 24 is mounted on a screw 26 connected to the handwheel 4. A ruler 43 is fixed parallel to the grooved profile 25 to adjust the stroke of the slider 24.

As regards the actuation of the die by means of the die shaft 2, it should be noted that, inside the box 1 provided with an upper cover 27 and a bottom cover 28, the die shaft 2 is integral with the die gear 29 driven by an actuator 30 comprising the rack rod 30*a* mounted on the piston 31 in the single-acting cylinder 32. The piston 31 is on one side in contact with the pressurized oil in the chamber of the single-acting cylinder 32, and on the other side abuts a return spring 33 which abuts at the other end thereof a retaining element 34 fastened with a ring nut 35 to the single-acting cylinder. It is clear that the head of the single-acting cylinder 32 could also be made differently. For example, the ring nut can be replaced by a thread of a male retaining element, and consequently the upper cover should be female. The retaining element 34 is similar to a superiorly open lid so that the free end of the rack rod 30*a* can protrude anteriorly from the box 1 of the rotary pipe bending machine through a front opening 41. Conveniently, the front opening 41 is closed with a spring-loaded small door 42, as shown in FIG. 4, which opens when the rack rod 30*a* comes out and closes when the rack rod 30*a* withdraws into the box 1. This, inter alia, has the advantage of preventing the entry of dust and dirt inside the box 1.

Figure 6:
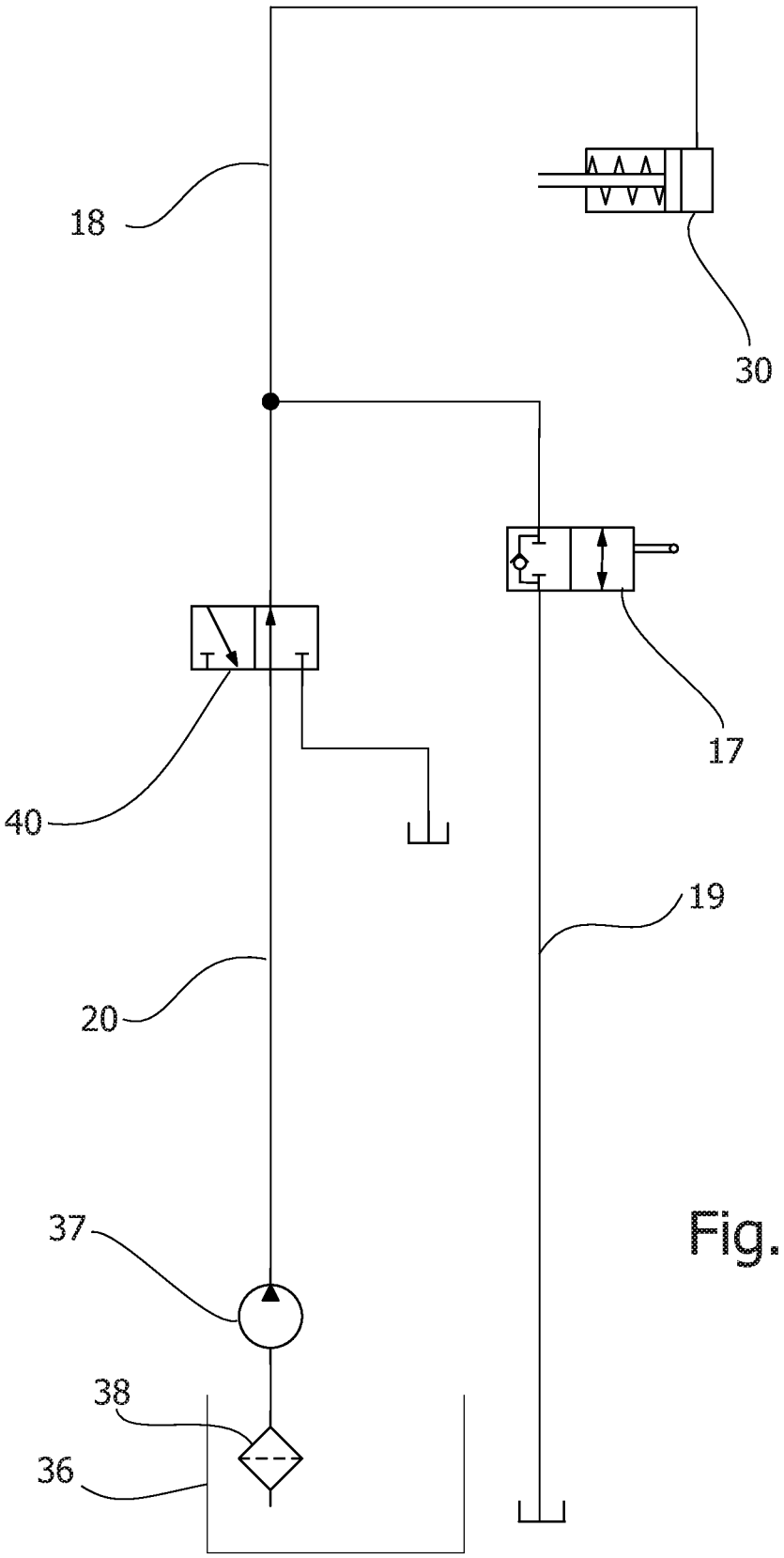
FIG. 6 is a schematic representation of the hydraulic circuit for the rotary pipe bending machine according to the invention.

The hydraulic circuit which drives the actuator 30 is shown schematically in FIG. 6. It comprises an oil tank 36 in which a pump 37 draws through a filter 38. The pump 37 is driven, for example, by an electric motor. It should be understood that the pump could also be of the manual type. The pump 37 is connected to the actuator 30, as described above. Downstream of the pump 37 there is an operating valve 40, and the limit switch 17 is provided downstream of the operating valve 40.

The operation of the rotary pipe bending machine according to the present invention is as follows. The elongated element to be bent is placed on the die and the counter is placed next to it. The desired angle of curvature is set on the angularly graduated disc 10. The hydraulic circuit pump is actuated which drives the actuator 30 with its rack rod 30*a* engaged with the die gear 29. At the end of the rotation set on the angularly graduated disc 10, the cam 16 acts on the button of the limit switch 17 and determines the opening of the limit switch valve with discharge of the pressure in the single-acting cylinder. In this way the return spring 33, by acting on the piston 31, causes the rack rod 30*a* of the actuator 30 to stop, interrupting the bending operation.

It should be understood that the objects of the present invention have been achieved. Thanks to the fact that a single-acting cylinder is used, having a rod equipped with a rack on the piston, and the box of the machine has an opening for the exit of the rod, a more compact machine is obtained, as shorter by at least the length of the toothing of the rack with respect to a cylinder which uses rod and rack that are distinct. In addition, the machine is lighter because it has fewer components, and therefore cheaper and more rigid.

The invention claimed is:

1. A hydraulically operated rotary pipe bending machine, comprising:

a box (1) from which superiorly protrude:

a die shaft (2) that is rigidly connected to a die and integral with a die gear (29) that is driven by an actuator (30) through a hydraulic circuit and stopped by a limit switch device (8); and a counter-die unit (3) that is driven by a handwheel (4) in order to place an elongated piece to be bent against said die, wherein said actuator (30) comprises a single-acting cylinder, having a piston (31) holding a rack rod (30*a*) engaging said die gear (29), the travel of the piston (31) being opposed by a return spring (33), and wherein said box (1) has a front opening (41) for the protrusion of the rack rod (30*a*) of the actuator (30), said front opening (41) being closed by a spring-charged door (42).

2. The rotary pipe bending machine according to claim 1, wherein the rack rod (30*a*) comprises a rack (30*b*) integral with the rack rod (30*a*).

3. The rotary pipe bending machine according to claim 1, wherein said hydraulic circuit comprises:

an oil tank (36);

a pump (37) which draws through a filter (38) in the oil tank (36) and is connected to the chamber (32) of the single-acting cylinder by way of an operating valve (40); and a limit switch (17) interposed between the chamber of the single-acting cylinder (32) and the operating valve (40).

4. The rotary pipe bending machine according to claim 3, wherein the limit switch device (8) comprises an angularly graduated disc (10) mounted, manually adjustable, on the die shaft (2) and provided with a cam (16) configured to control said limit switch (17).

5. The rotary pipe bending machine according to claim 3, wherein the pump (37) is driven by an electric motor.

6. The rotary pipe bending machine according to claim 3, wherein the pump (37) is manually operated.

* * * * *